US008376562B2

(12) United States Patent
Osawa et al.

(10) Patent No.: US 8,376,562 B2
(45) Date of Patent: Feb. 19, 2013

(54) LIGHT-EMITTING MODULE, SELF-BALLASTED LAMP AND LIGHTING EQUIPMENT

(75) Inventors: Shigeru Osawa, Yokosuka (JP); Masahiko Kamata, Yokosuka (JP); Takuro Hiramatsu, Yokosuka (JP); Tsutomu Araki, Yokosuka (JP); Hitoshi Kawano, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/886,123

(22) Filed: Sep. 20, 2010

(65) Prior Publication Data

US 2011/0074291 A1 Mar. 31, 2011

(30) Foreign Application Priority Data

Sep. 25, 2009 (JP) ..... 2009-221634

(51) Int. Cl.
*F21V 33/00* (2006.01)

(52) U.S. Cl. ..... 362/95; 362/157; 362/227; 362/800

(58) Field of Classification Search ..... 362/95, 362/157, 166, 227, 230, 231, 236, 237, 240, 362/249.01, 249.02, 311.01, 311.02, 368, 362/800, 612, 555, 545, 543, 544
See application file for complete search history.

(56) References Cited

U.S. PATENT DOCUMENTS

| | | | |
|---|---|---|---|
| 1,972,790 | A | 9/1934 | Olley |
| 3,747,181 | A | 7/1973 | Nykopp et al. |
| 4,355,853 | A | 10/1982 | Kourimsky |
| 4,440,214 | A | 4/1984 | Wedel |
| 4,503,360 | A | 3/1985 | Bedel |
| 4,630,182 | A | 12/1986 | Moroi |
| 4,823,450 | A | 4/1989 | Ramisch et al. |
| 4,939,420 | A | 7/1990 | Lim |
| 5,327,332 | A | 7/1994 | Hafemeister |
| D356,107 | S | 3/1995 | Watanabe et al. |
| 5,537,301 | A | 7/1996 | Martich |
| 5,556,584 | A | 9/1996 | Yamazaki |
| 5,567,448 | A | 10/1996 | Frankland |

(Continued)

FOREIGN PATENT DOCUMENTS

| | | |
|---|---|---|
| CN | 1834567 | 9/2006 |
| CN | 101307887 | 11/2008 |

(Continued)

OTHER PUBLICATIONS

English Language Abstract of JP 2001-243809 published Sep. 7, 2001.

(Continued)

*Primary Examiner* — Danielle Allen
(74) *Attorney, Agent, or Firm* — DLA Piper LLP (US)

(57) ABSTRACT

A light-emitting module includes a module substrate, semiconductor light-emitting elements and a connection substrate. On one face of the module substrate, a conductive layer is formed. The semiconductor light-emitting elements and the connection substrate are mounted on the conductive layer of the module substrate. Electric wires, which extend from a lighting circuit, are connected to the connection substrate. Power is supplied to the semiconductor light-emitting elements through the connection substrate and the conductive layer of the module substrate.

8 Claims, 7 Drawing Sheets

U.S. PATENT DOCUMENTS 5,585,697 A 12/1996 Cote
5,632,551 A 5/1997 Roney
5,775,792 A 7/1998 Wiese
5,785,418 A 7/1998 Hochstein
5,857,767 A 1/1999 Hochstein
5,947,588 A * 9/1999 Huang ..... 362/235
6,095,668 A 8/2000 Rykowski et al.
6,129,017 A 10/2000 Mohrmann et al.
6,161,910 A 12/2000 Reisenauer
6,186,646 B1 2/2001 Wiedemer
6,227,679 B1 5/2001 Zhang et al.
6,234,649 B1 5/2001 Katougi
6,294,973 B1 9/2001 Kimura
6,502,968 B1 1/2003 Simon
6,517,217 B1 2/2003 Liao
6,525,668 B1 2/2003 Petrick
6,598,996 B1 * 7/2003 Lodhie ..... 362/249.05
6,641,283 B1 11/2003 Bohler
6,787,999 B2 9/2004 Stimac et al.
D497,439 S 10/2004 Shaw et al.
6,814,470 B2 11/2004 Rizkin et al.
6,936,855 B1 8/2005 Harrah
6,948,829 B2 9/2005 Verdes et al.
6,982,518 B2 1/2006 Chou et al.
7,059,748 B2 6/2006 Coushaine
7,074,104 B2 7/2006 Itaya
7,111,961 B2 9/2006 Trenchard
7,125,146 B2 10/2006 Willis
D534,038 S 12/2006 Kramer et al.
7,144,140 B2 12/2006 Sun et al.
D534,665 S 1/2007 Egawa et al.
7,165,866 B2 1/2007 Li
7,198,387 B1 4/2007 Gloisten et al.
7,226,189 B2 6/2007 Lee et al.
7,281,818 B2 10/2007 You
7,300,173 B2 11/2007 Catalano
7,329,024 B2 2/2008 Lynch
7,331,689 B2 2/2008 Chen
7,347,589 B2 3/2008 Ge
7,367,794 B2 5/2008 Sano
7,431,477 B2 10/2008 Chou et al.
7,497,596 B2 3/2009 Ge
7,631,987 B2 12/2009 Wei
7,679,096 B1 3/2010 Ruffin
7,758,223 B2 7/2010 Osawa et al.
7,811,218 B2 10/2010 Sano et al.
7,824,075 B2 11/2010 Maxik
7,919,339 B2 4/2011 Hsu
7,947,596 B2 5/2011 Takeda
7,963,686 B2 6/2011 Hu
8,058,784 B2 11/2011 Treurniet
8,066,417 B2 11/2011 Balazs
2002/0012246 A1 1/2002 Rincover et al.
2002/0024814 A1 2/2002 Matsuba
2003/0063476 A1 4/2003 English et al.
2003/0117797 A1 6/2003 Sommers et al.
2003/0117801 A1 6/2003 Lin
2003/0137838 A1 7/2003 Rizkin et al.
2003/0151917 A1 * 8/2003 Daughtry et al. ..... 362/231
2004/0012955 A1 1/2004 Hsieh
2004/0109310 A1 1/2004 Naljotov
2004/0120156 A1 6/2004 Ryan
2004/0145898 A1 7/2004 Ase et al.
2004/0156191 A1 8/2004 Biasoli
2004/0218385 A1 11/2004 Tomiyoshi
2005/0007772 A1 1/2005 Yen
2005/0024864 A1 2/2005 Galli
2005/0068776 A1 3/2005 Ge
2005/0073244 A1 4/2005 Chou et al.
2005/0111234 A1 5/2005 Martin et al.
2005/0162864 A1 * 7/2005 Verdes et al. ..... 362/555
2005/0174769 A1 * 8/2005 Yong et al. ..... 362/235
2005/0243552 A1 * 11/2005 Maxik ..... 362/249
2005/0254246 A1 11/2005 Huang
2006/0043546 A1 3/2006 Kraus
2006/0092640 A1 5/2006 Li
2006/0193130 A1 8/2006 Ishibashi
2006/0193139 A1 8/2006 Sun
2006/0198147 A1 9/2006 Ge
2006/0211556 A1 9/2006 Sano
2006/0215408 A1 9/2006 Lee
2006/0227558 A1 10/2006 Osawa
2006/0239002 A1 10/2006 Chou et al.
2007/0002570 A1 1/2007 Souza
2007/0041182 A1 2/2007 Ge et al.
2007/0096114 A1 5/2007 Aoki
2007/0103904 A1 5/2007 Chen
2007/0279903 A1 12/2007 Negley
2008/0002100 A1 1/2008 Kaneko
2008/0037255 A1 2/2008 Wang
2008/0084701 A1 4/2008 Van De Ven
2008/0112170 A1 5/2008 Trott
2008/0130298 A1 6/2008 Negley
2008/0173883 A1 7/2008 Hussell
2008/0289867 A1 11/2008 Owens
2009/0059595 A1 3/2009 Ge
2009/0116229 A1 5/2009 Dalton
2009/0116231 A1 5/2009 Miller
2009/0175041 A1 7/2009 Yuen et al.
2009/0184616 A1 7/2009 Van de Ven
2009/0184646 A1 7/2009 Devaney
2009/0207602 A1 8/2009 Reed
2009/0294780 A1 12/2009 Chou
2009/0297777 A1 12/2009 Sano et al.
2010/0026157 A1 2/2010 Tanaka
2010/0060130 A1 3/2010 Li
2010/0067241 A1 3/2010 Lapatovich
2010/0096992 A1 4/2010 Yamamoto
2010/0119639 A1 5/2010 Sano et al.
2010/0207534 A1 8/2010 Dowling
2010/0219735 A1 9/2010 Sakai et al.
2010/0225220 A1 9/2010 Tanaka et al.
2010/0237761 A1 9/2010 Osawa et al.
2010/0237779 A1 9/2010 Osawa et al.
2010/0244650 A1 9/2010 Osawa et al.
2010/0244694 A1 9/2010 Osawa et al.
2010/0253200 A1 10/2010 Osawa et al.
2010/0277082 A1 11/2010 Reed
2010/0289393 A1 11/2010 Cantrell et al.
2010/0289396 A1 11/2010 Osawa
2010/0315442 A1 12/2010 Pauritsch
2010/0327746 A1 12/2010 Hisayasu
2010/0327751 A1 12/2010 Takenaka et al.
2011/0025206 A1 2/2011 Hiramatsu et al.
2011/0063842 A1 3/2011 Takei et al.
2011/0068674 A1 3/2011 Takenaka et al.
2011/0074269 A1 3/2011 Hisayasu et al.
2011/0074271 A1 3/2011 Takeshi et al.
2011/0074290 A1 3/2011 Sakai et al.
2011/0074291 A1 3/2011 Osawa et al.
2011/0089806 A1 4/2011 Suwa et al.
2011/0156569 A1 6/2011 Osawa
2011/0210664 A1 9/2011 Hisayasu et al.

FOREIGN PATENT DOCUMENTS

DE 10 2004 042186 3/2006
DE 102006012398 9/2006
DE 102006044463 5/2007
DE 20 2008 016 231 4/2009
EP 1705421 9/2006
EP 2037633 3/2009
EP 2149742 2/2010
EP 2 163 808 3/2010
JP 57-152706 9/1982
JP 59-035303 2/1984
JP 61-35216 2/1986
JP 62-190366 12/1987
JP 63-5581 1/1988
JP 63-102265 5/1988
JP 64-7204 1/1989
JP 1-206505 8/1989
JP 2-91105 3/1990
JP H 03-227858 10/1991
JP H 10-217314 8/1998
JP H 11-314263 11/1999
JP 2000-083343 3/2000
JP 2000-173303 6/2000

| | | |
|---|---|---|
| JP | 2000-239409 | 9/2000 |
| JP | 2001-243809 | 9/2001 |
| JP | 2002-525814 | 8/2002 |
| JP | 2002-280617 | 9/2002 |
| JP | 2003-016808 | 1/2003 |
| JP | 2003-059305 | 2/2003 |
| JP | 2003-59330 | 2/2003 |
| JP | 2003-92022 | 3/2003 |
| JP | 2004-6096 | 1/2004 |
| JP | 2004-119078 | 4/2004 |
| JP | 2004-193053 | 7/2004 |
| JP | 2004-6096 | 8/2004 |
| JP | 2004-221042 | 8/2004 |
| JP | 2005-93097 | 4/2005 |
| JP | 2005-123200 | 5/2005 |
| JP | 2005-513815 | 5/2005 |
| JP | 2005-166578 | 6/2005 |
| JP | 2005-286267 | 10/2005 |
| JP | 2006-040727 | 2/2006 |
| JP | 3121916 | 5/2006 |
| JP | 2006-156187 | 6/2006 |
| JP | 2006-244725 | 9/2006 |
| JP | 2006-256159 | 9/2006 |
| JP | 2006-310057 | 11/2006 |
| JP | 2006-313717 | 11/2006 |
| JP | 2006-313718 | 11/2006 |
| JP | 2007-073306 | 3/2007 |
| JP | 2007-083577 | 4/2007 |
| JP | 2007-188832 | 7/2007 |
| JP | 2007-207576 | 8/2007 |
| JP | 2008-027910 | 2/2008 |
| JP | 2008-91140 | 4/2008 |
| JP | 2008-227412 | 9/2008 |
| JP | 2008-277561 | 11/2008 |
| JP | 2009-37995 | 2/2009 |
| JP | 2009-117342 | 5/2009 |
| JP | 2009-135026 | 6/2009 |
| JP | 2009-206104 | 8/2009 |
| WO | WO 03/056636 | 7/2003 |
| WO | WO 2005/024898 | 3/2005 |
| WO | WO 2006/118457 | 11/2006 |
| WO | WO 2008/146694 | 12/2008 |
| WO | WO 2009/087897 | 7/2009 |

OTHER PUBLICATIONS

English Language Abstract of JP Publication 01-206505 published Aug. 18, 1989.
English Language Abstract of JP Publication 2005-093097 published Apr. 7, 2005.
English Language Abstract of JP Publication 2005-123200 published May 12, 2005.
English Language Abstract of JP 2006-313718 published Nov. 16, 2006.
English Language Abstract of JP Publication 63-005581 published Jan. 11, 1988.
English Language Abstract of JP Publication 64-007402 published Jan. 11, 1989.
English Language Machine Translation of JP 2000-083343, published Mar. 21, 2000.
English Language Machine Translation of JP 2000-173303 published Jun. 23, 2000.
English Language Machine Translation of JP 2001-243809 published Sep. 7, 2001.
English Language Machine translation of JP 2003-59330 published Feb. 28, 2003.
English Language Machine Translation of JP 2004-006096 published Jan. 8, 2004.
English Language Machine Translation of JP 2004-193053 published Jul. 8, 2004.
English Language Machine Translation of JP 2005-166578 published Jun. 23, 2005.
English Language Machine translation of JP 2005-513815 published May 12, 2005.
English Language Machine translation of JP 2006-040727 published Feb. 9, 2006.
English Language Machine Translation of JP 2006-310057, published Nov. 9, 2006.
English Language Machine Translation of JP 2006-313718, published Nov. 16, 2006.
English Language Machine translation of JP 2008-91140 published Apr. 17, 2008.
English Language Machine Translation of JP 2009-37995, published Feb. 19, 2009.
English Language Machine Translation of JP 3121916, published May 10, 2006.
English Language Machine Translation of JP Publication 2005-093097 published Apr. 7, 2005.
English Language Machine Translation of JP Publication 2005-123200.
English Language Machine translation of JP-2002-280617published Sep. 27, 2002.
English Language Machine translation of JP-2005-286267 published Oct. 13, 2005.
English Language Machine translation of JP-2006-244725 published Sep. 14, 2006.
English Language Machine Translation ofJP 2003-092022 published Mar. 28, 2003.
English Language Translation of Office Action issued in corresponding Japanese Appl 2005-221571 on Oct. 20, 2009.
English Language Translation of International Search Report for PCT/JP2008/073436 mailed Mar. 24, 2009.
English translation of Office Action issued in corresponding Japanese Appl 2005-221571 on Jul. 7, 2009.
English translation of Office Action issued in corresponding Japanese Appl 2005-221571 on Aug. 25, 2009.
English Language Translation of Office Action issued in Japanese Appl 2005-221688 on Jan. 26, 2010.
Machine Enalish language translation of JP-2003-016808 published Jan. 17, 2003.
Office Action issued in corresponding Japanese Appl 2005-221571 on Jul. 7, 2009.
Office Action issued in corresponding Japanese Appl 2005-221571 on Aug. 25, 2009.
Office Action issued in corresponding Japanese Appl 2005-221571 on Oct. 20, 2009.
Search Report of International Application No. PCT/JP2008/068625 mailed Dec. 9, 2008.
English Language Abstract of JP 2004-193053 published Jul. 8, 2004.
English Language Abstract of JP 2-91105 published Mar. 30, 1990.
English Language Abstract of JP 2000-173303 published Jun. 23, 2000.
English Language Abstract of JP 2003-092022 published Mar. 28, 2003.
English language abstract of JP-2002-280617 published Sep. 27, 2002.
English language abstract of JP-2003-016808 published Jan. 17, 2003.
English Language Abstract of 2003-59330 published Feb. 28, 2003.
English Language Abstract of JP 2005-166578 published Jun. 23, 2005.
English language abstract of JP-2005-286267 published Oct. 13, 2005.
English Language Abstract of JP 2006-040727 published Feb. 9, 2006.
English language abstract of JP-2006-244725 published Sep. 14, 2006.
English Language Abstract of JP 2008-91140 published Apr. 17, 2008.
English Language Abstract of JP 2004-006096 published Jan. 8, 2004.
Office Action issued in Japanese Appl 2005-221688 on Jan. 26, 2010.
English Language Abstract of JP 2009-37995, published Feb. 19, 2009.
English Language Abstract of JP 2000-083343, published Mar. 21, 2000.
English Language Abstract of JP 57-152706 published Sep. 21, 1982.

English Language Abstract of JP 2006-313718, published Nov. 16, 2006.
English Language Abstract of JP 2006-310057, published Nov. 9, 2006.
International Preliminary Report on Patentability and Written Opinion issued in PCT/JP2008/068625 mailed May 11, 2010.
Office Action issued in Japanese Appl 2005-371406 on Apr. 20, 2010.
English Translation of Office Action issued in Japanese Appl 2005-371406 on Apr. 20, 2010.
U.S. Appl. No. 12/825,650.
U.S. Appl. No. 12/794,558.
Japanese Office Action issued in JP 2008-198625 on May 26, 2010.
English Translation of Japanese Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.
I English Language Abstract of JP 2009-135026 published Jun. 18, 2009.
English Language Translation of JP 2009-135026 published Jun. 18, 2009.
English Language Abstract of JP 2002-525814 published Aug. 13, 2002.
English Language Abstract of JP 2003-059305 published Aug. 28, 2003.
English Language Translation of JP 2003-059305 published Feb. 28, 2003.
English Language Translation of JP 2009-037995 published Feb. 19, 2009.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.
English Language Translation of JP 2007-073306 published Mar. 22, 2007.
U.S. Appl. No. 12/880,490.
U.S. Appl. No. 12/886,123.
U.S. Appl. 11/399,492 (now U.S. Patent 7,758,223).
Extended European Search Report issued in EP Appl 10006720.6 on Oct. 13, 2010.
English Language Abstract of JP 61-35216 published Feb. 2, 1986.
IPRP & WO issued in PCT/JP2008/073436 on Aug. 10, 2010.
English abstract of JP-2006-256159 published Sep. 26, 2006.
Machine English language translation of JP-2006-256159 published Sep. 26, 2006.
Notice of Allowance issued in counterpart Taiwan Application No. 096147234 on Jan. 26, 2010.
Search Report issued in counterpart Taiwan Application No. 096147234 on Jan. 26, 2010.
English abstract of CN1834567A issued on Sep. 20, 2006.
Machine English language translation of JP 3194904B2 issued on Aug. 6, 2001.
Korean Office Action issued in KR Appl. No. 10-2009-46397 on Nov. 19, 2010.
Partial English Language Translation of Korean Office Action issued in KR Appl. No. 10-2009-46397 on Nov. 19, 2010.
Office Action issued in JP 2005-376468 on Apr. 13, 2010.
English Language Translation of Office Action issued in JP 2005-376468 on Apr. 13, 2010.
Office Action issued in JP 2005-376029 on Apr. 13, 2010.
English Language Translation of Office Action issued in JP 2005-376029 on Apr. 13, 2010.
English Language Abstract of JP 2000-239409 published Sep. 5, 2000.
English machine language translation of JP 2000-239409 published Sep. 5, 2000.
English Language Abstract of JP H 10-217314 published Aug. 18, 1998.
English machine language translation of JP H 10-217314 published Aug. 18, 1998.
English Language Abstract of JP 2007-083577 published Apr. 5, 2007.
English machine language translation ofJP 2007-083577 published Apr. 5, 2007.
English Language Abstract of JP H 11-314263 published Nov. 16, 1999.
English machine language translation of JP H 11-314263 published Nov. 16, 1999.
U.S. Appl. No. 11/614,223.
U.S. Appl. No. 12/473,579.
U.S. Appl. No. 12/518,511.
U.S. Appl. No. 11/534,339.
U.S. Appl. No. 12/877,720.
English Language Abstract of JP 3-227858 published Oct. 8, 1991.
International Search Report issued in PCT/JP2007/073797 published Feb. 5, 2008.
English Language Translation of JP 2002-525814 published Aug. 13, 2002.
English Language Abstract of JP 2006-156187 published Jun. 15, 2006.
English Language Translation of JP 2006-156187 published Jun. 15, 2006.
U.S. Appl. No. 12/888,921.
U.S. Appl. No. 13/034,959.
U.S. Appl. No. 12/825,650, filed Jun. 29, 2010, pending.
U.S. Appl. No. 12/794,379, filed Jun. 4, 2010, pending.
U.S. Appl. No. 12/794,429, filed Jun. 4, 2010, pending.
U.S. Appl. No. 12/794,476, filed Jun. 4, 2010, pending.
U.S. Appl. No. 12/794,509, filed Jun. 4, 2010, pending.
U.S. Appl. No. 12/811,795, filed Jul. 6, 2010, pending.
U.S. Appl. No. 12/794,558, filed Apr. 15, 2010, pending.
U.S. Appl. No. 12/713,230, filed Feb. 26, 2010, pending.
U.S. Appl. No. 12/825,956, filed Jun. 29, 2010, pending.
U.S. Appl. No. 12/880,490, filed Sep. 13, 2010, pending.
U.S. Appl. No. 12/845,330, filed Jul. 28, 2010, pending.
U.S. Appl. No. 12/885,005, filed Sep. 17, 2010, pending.
U.S. Appl. No. 12/933,969, filed Sep. 22, 2010, pending.
U.S. Appl. No. 12/885,849, filed Sep. 20, 2010, pending.
U.S. Appl. No. 12/886,025, filed Sep. 20, 2010, pending.
U.S. Appl. No. 12/886,123, filed Sep. 20, 2010, pending.
U.S. Appl. No. 13/044,369, filed Mar. 9, 2011, pending.
U.S. Appl. No. 13/034,959, filed Feb. 25, 2011, pending.
U.S. Appl. No. 13/172,557 electronically captured on Jul. 6, 2011.
Extended European Search Report issued in EP 111560003.9 on May 18, 2011.
Extended European Search Report issued in EP 08838942.4 on Jun. 1, 2011.
English Language Abstract of JP 2008-277561 published on Nov. 13, 2008.
English Language Translation of JP 2008-277561 published on Nov. 13, 2008.
U.S. Appl. No. 12/738,081 captured on Apr. 16, 2011 to Jul. 6, 2011.
U.S. Appl. No. 13/221,551.
English Language Abstract of JP 2004-119078 published Apr. 15, 2004.
English Language Translation of JP 2004-119078 published Apr. 15, 2004.
Chinese Office Action issued in CN 201010216943 on Oct. 26, 2011.
English Language Translation of Chinese Office Action issued in CN 201010216943 on Oct. 26, 2011.
English Language Abstract of CN 101307887 published Nov. 19, 2008.

English Language Translation of JP 2009/117342 published May 28, 2009.
English Language Abstract of JP 2009/117342 pubslished May 28, 2009.
English Language Abstract of JP 2008-227412 published Sep. 25, 2008.
English Language Translation of JP 2008-227412 published Sep. 25, 2008.
Japanese Office Action issued in 2005-269017 on Jan. 13, 2011.
English Language Translation of JP Office Action issued in 2005-269017 on Jan. 13, 2011.
English Language Abstract of JP 2004-221042 published Aug. 5, 2004.
English Language Translation of JP 2004-221042 published Aug. 5, 2004.
jEnglish Language Abstract of JP 63-102265 published May 7, 1988.
English Language Abstract of JP 2009-206104 published Sep. 10, 2009.
English Language Translation of JP 2009-206104 published Sep. 10, 2009.
European Search Report issued in EP 10178361.1 on Jul. 4, 2011.
U.S. Appl. No. 13/172,557, filed Jun. 29, 2011, pending.
U.S. Appl. No. 13/221,519, filed Aug. 30, 2011, pending.
U.S. Appl. No. 13/221,551, Aug. 30, 2011, pending.
U.S. Appl. No. 12/794,379.
U.S. Appl. No. 12/794,509.
U.S. Appl. No. 12/933,969.
U.S. Appl. No. 12/825,956.
U.S. Appl. No. 12/885,005.
U.S. Appl. No. 12/886,025.
U.S. Appl. No. 13/888,921.
Chinese Office Action issued in CN 201010121809.11 on Mar. 31, 2012.
English Translation of Chinese Office Action issued in CN 201010121809.11 on Mar. 31, 2012.
English Language Abstract and Claims of CN201149860 published Nov. 12, 2008.
English Language Abstract and Claims of CN201072113 published Jun. 11, 2008.
English Language Abstract of CN2602514 published Feb. 4, 2004.
Extended European Search Report for EP 10179580.5-1264 dated May 24, 2012.
U.S. Appl. No. 12/794,429.
U.S. Appl. No. 12/794,476.
U.S. Appl. No. 12/811,795.
U.S. Appl. No. 12/738,081.
U.S. Appl. No. 12/713,230.
U.S. Appl. No. 12/845,330.
U.S. Appl. No. 12/885,849.
U.S. Appl. No. 13/044,369.
U.S. Appl. No. 13/221,519.

* cited by examiner (a)

(b)

(a)

(b)

(c)

LIGHT-EMITTING MODULE, SELF-BALLASTED LAMP AND LIGHTING EQUIPMENT

The present invention claims priority under 35 U.S.C. §119 to Japanese Patent Application No. 2009-221634 filed on Sep. 25, 2009. The contents of these applications are incorporated herein by reference in their entirety.

FIELD

Embodiments described herein relate generally to a light-emitting module using semiconductor light-emitting elements, a self-ballasted lamp using the light-emitting module and lighting equipment using the self-ballasted lamp.

BACKGROUND

In a conventional self-ballasted lamp using LED chips as semiconductor light-emitting elements, a light-emitting module mounting the LED chips and a globe that covers the light-emitting module are attached to one side of a metallic base body, a cap is attached to the other side of the base body via an insulating member, a lighting circuit is housed inside the insulating member, and the lighting circuit and a module substrate are connected to each other through electric wires, and power is supplied from the lighting circuit to the LED chips mounted on the module substrate.

The light-emitting module has the module substrate. For example, SMD (Surface Mount Device) packages with connection terminals, on which the LED chips are loaded respectively, are mounted on one face of the module substrate, and the other face of the module substrate is thermally-conductively brought into contact with and attached to the base body.

In order to connect the electric wires, which extend from the lighting circuit, to the module substrate, a terminal block is attached to one face of the module substrate, and the electric wires which extend from the lighting circuit and are routed from the other face side to the one face side through a side face of the module substrate, are connected to the terminal block.

For example, in the self-ballasted lamp, it is effective to use a substrate, which is made of metal such as aluminum excellent in thermal conductivity, for the module substrate so that heat generated by the LED chips is effectively thermally conducted from the module substrate to the base body side and radiated during lighting. On the metallic substrate, parts cannot be mounted by inserting part of the parts through hole penetrated on the insulation substrate like an insulating substrate because it has conductivity. Therefore, all parts to be mounted on the metallic substrate are required to be a surface mount type, and a surface mount type terminal block is tall but used as the terminal block.

However, since the tall terminal block is arranged on one face on which the LED chips are mounted on the module substrate, light emitted from the LED chips is easily blocked by the terminal block, optical characteristics are affected and a shadow of the terminal block is easily reflected on the globe.

The present invention has been made in view of the above problems and aims to provide a light-emitting module, a self-ballasted lamp and lighting equipment, the module being capable of reducing influence on optical characteristics caused by connection portions of electric wires to the module substrate.

DETAILED DESCRIPTION

A light-emitting module of each embodiment includes a module substrate, semiconductor light-emitting elements and a connection substrate. On one face side of the module substrate, a conductive layer is formed. The semiconductor light-emitting elements and the connection substrate are mounted on the conductive layer of the module substrate. Electric wires which extend from a lighting circuit are connected to the connection substrate. Power is supplied to the semiconductor light-emitting elements through the connection substrate and the conductive layer of the module substrate.

Next, Embodiment 1 will be described with reference to FIGS. 1 to 6.

Figure 1:
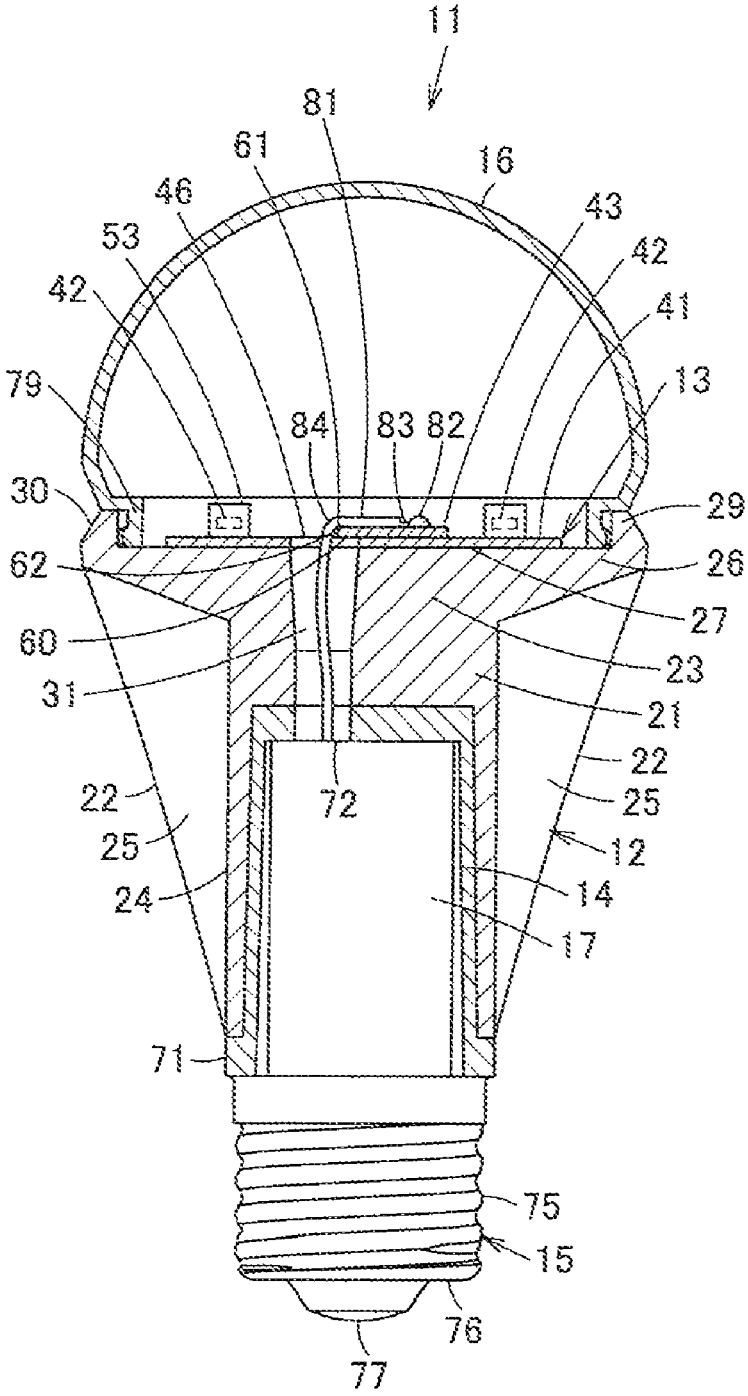
FIG. 1 is a cross sectional view of a self-ballasted lamp of Embodiment 1.

The reference numeral 11 denotes a self-ballasted lamp in FIG. 1, and the self-ballasted lamp 11 includes: a base body 12; a light-emitting module 13 attached to one end side (one end side in a lamp axial direction along a virtual center line of the self-ballasted lamp 11) of the base body 12; a cover 14 attached to the other end side of the base body 12; a cap 15 attached to the other end side of the cover 14; a globe 16 that covers the light-emitting module 13 and is attached to one end side of the base body 12; and a lighting circuit 17 housed inside the cover 14 between the base body 12 and the cap 15.

The base body 12 is integrally formed of, for example, metal such as aluminum or ceramics, excellent in thermal conductivity and heat radiation performance, a base body portion 21 as a body portion is formed in a center region of the base body 12, and a plurality of heat radiating fins 22 are projected in a radiating manner around the lamp axis along the lamp axial direction on a circumference of the base body portion 21.

On one end side of the base body portion 21, a columnar solid portion 23 is formed, and on the other end side thereof, a cylindrical portion 24 opening toward the other end side is formed.

The heat radiating fin 22 is obliquely formed so that the amount of projection of the fin in a radial direction from the other end side to the one end side of the base body 12 slowly increases. Additionally, the heat radiating fins 22 are formed in a radiating manner at an approximately even interval in the circumferential direction of the base body 12, and a gap 25 is formed between the adjacent heat radiating fins 22. The gaps 25 are opened toward the other end side and the periphery of the base body 12, and closed at one end side of the base body 12. On one end sides of the heat radiating fins 22 and gaps 25, an annular edge portion 26 continuing to the solid portion 23 is formed on the circumference of the solid portion 23.

Figure 2:
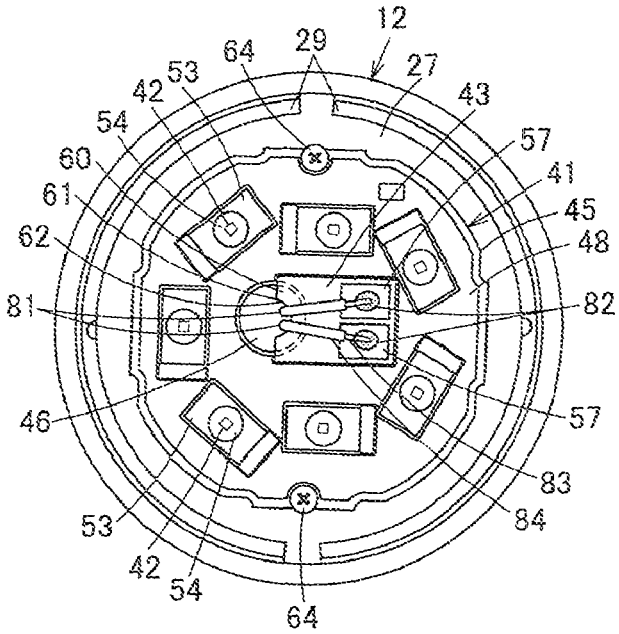
FIG. 2 is a front view of a base body and a light-emitting module of the self-ballasted lamp viewed from one end side.
Figure 3:
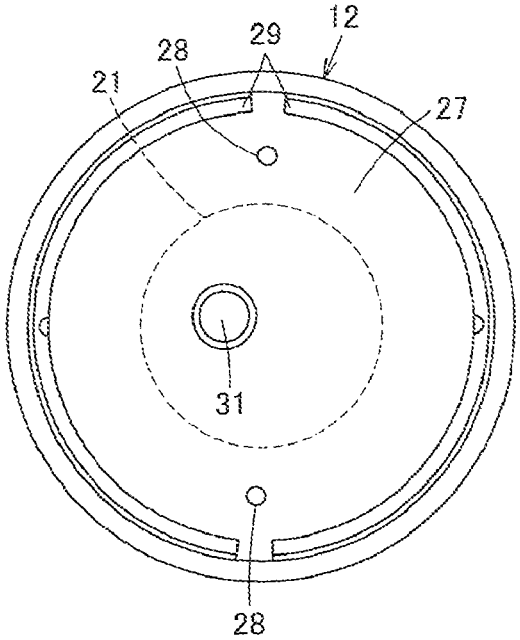
FIG. 3 is a front view of the base body viewed from one end side.

As shown in FIGS. 2 and 3, an attachment face 27, with and to which the light-emitting module 13 is brought into face-contact and attached, is formed at a center region of a face of one end side of the base body 12, and a plurality of attachment holes 28, to which the light-emitting module 13 is screwed, are formed in the attachment face 27. In a circumferential region of one end side of the base body 12, an annular attachment portion 29, to which the globe 16 is attached, is projected. An inclined portion 30 having a small diameter on the globe 16 side as its one end side is formed in an outer circumference of the attachment portion 29.

In the base body portion 21 of the base body 21, a wiring hole 31 for making the face of one end side of the base body 12 communicate with an inner face of the cylindrical portion 24 of the other end side of the base body 12 is formed along the lamp axial direction at a position away from the center of the lamp axis.

Additionally, as shown in FIG. 1, the light-emitting module 13 includes: a module substrate 41; LED chips 42 as semiconductor light-emitting elements mounted on one face of the module substrate 41; and a connection substrate 43.

Figure 4:
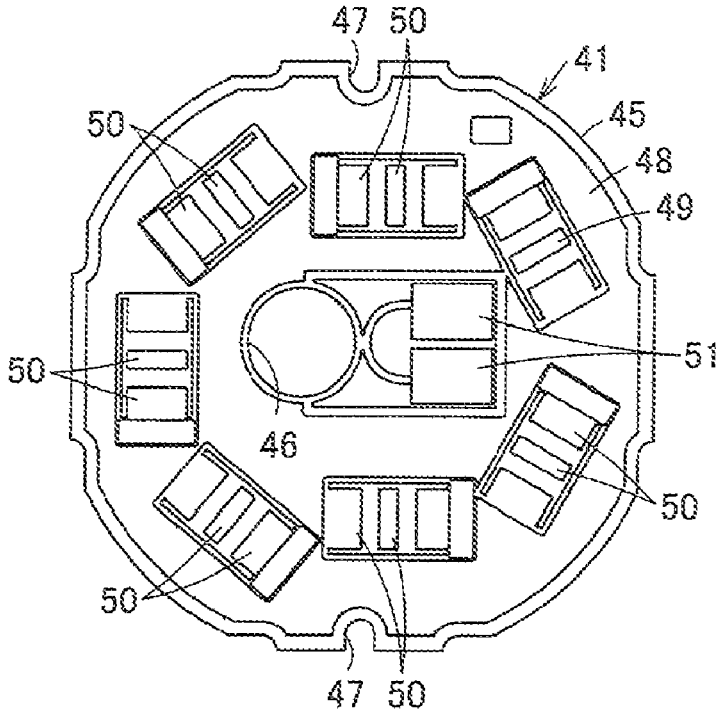
FIG. 4 show a module substrate of the light-emitting module, FIG. 4(*a*) is a front view showing one face of the substrate and FIG. 4(*b*) is an enlarged cross sectional view of a part of the substrate.
Figure 4:
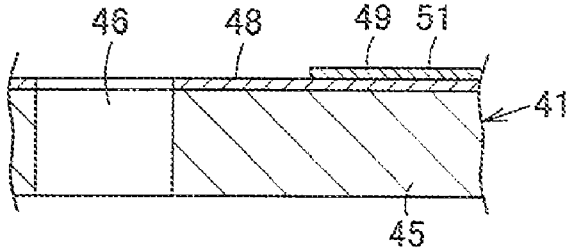

As shown in FIG. 4, the module substrate 41 has an approximately circular flat module substrate main body 45 formed of, for example, metal such as aluminum or ceramics excellent in thermal conductivity. A through-hole 46 penetrating one face and the other face is formed in an inside region of the module substrate main body 45 so as to correspond to the wiring hole 31 of the base body 12, and a plurality of attachment grooves 47 are formed in an edge portion of the module substrate main body 45. In the case where the module substrate main body 45 is made of metal, a conductive layer 49 is formed over one face of the module substrate main body 45 via an insulating layer 48. In the case where the module substrate main body 45 is made of ceramics having insulation properties, the conductive layer 49 is directly formed on one face of the module substrate main body 45. The conductive layer 49 is formed of a conductive material such as copper so as to have a predetermined wiring pattern, a plurality of pad portions 50 as semiconductor light-emitting element mounting portions mounting the LED chips 42 are formed at the peripheral region of the module substrate main body 45, a pair of pad portions 51 as a connection substrate mounting portion mounting the connection substrate 43 is formed in the vicinity of the through-hole 46 at a center region of the module substrate main body 45, and a wiring portion (not shown) for connecting the pad portions 50 and 51 to each other is formed.

As shown in FIGS. 1 and 2, as the LED chip 42, an SMD (Surface Mount Device) package 53 with connection terminals is used on which the LED chip 42 is loaded. Regarding the SMD package 53, the LED chip 92 emitting, for example, blue light is arranged in a package and sealed with a phosphor layer 54 made of, for example, silicone resin in which a yellow phosphor is mixed which is excited by a part of the blue color emitted from the LED chips 42 and emits yellow light. Accordingly, a surface of the phosphor layer 59 serves as a light-emitting face, and white-based light is emitted from the light-emitting face. Terminals (not shown) to be electrically connected to the module substrate 41 are arranged on a back face of the SMD package 53.

Figure 5:
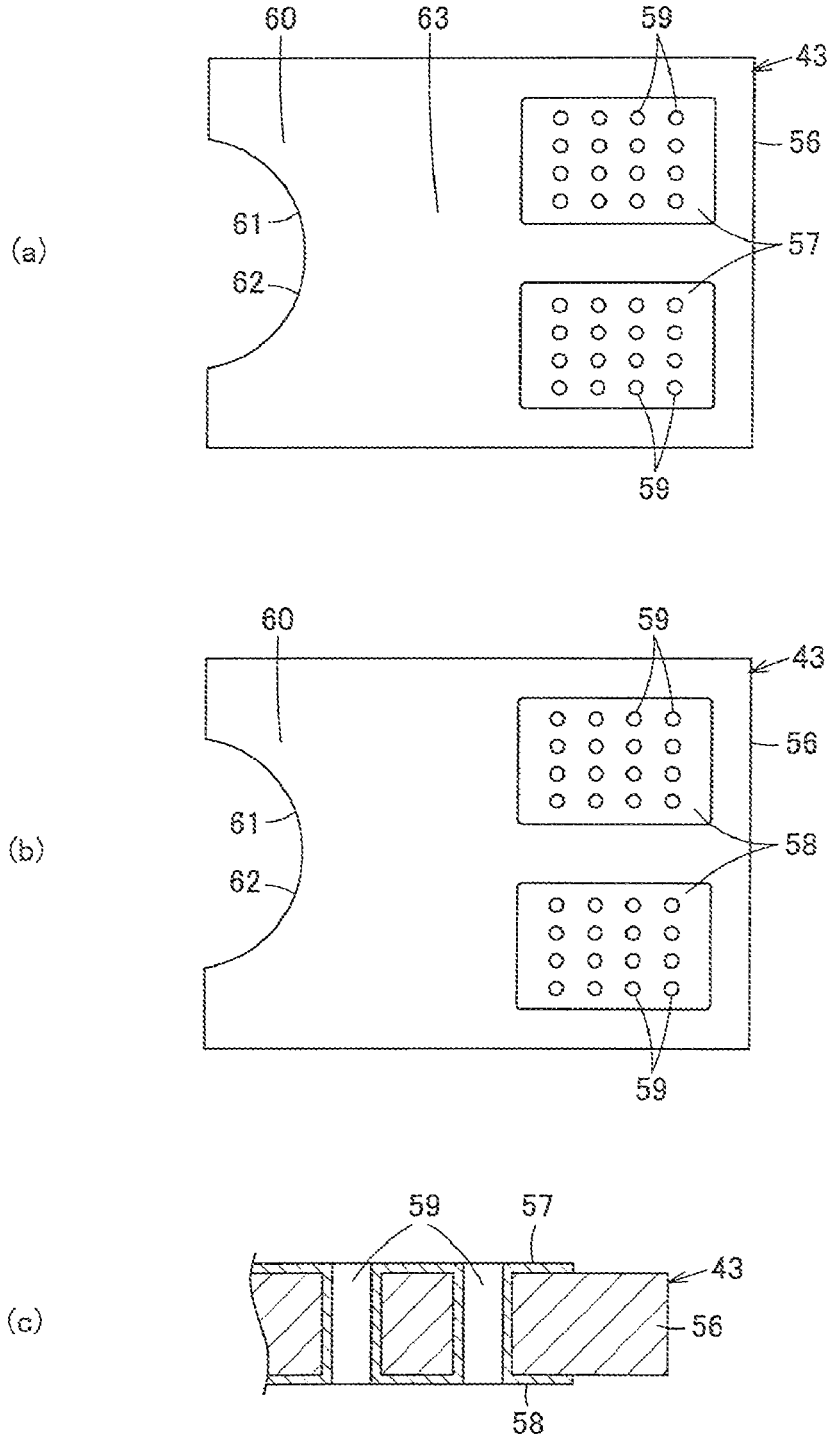
FIG. 5 show a connection substrate of the light-emitting module, FIG. 5(*a*) is a front view showing one face of the substrate, FIG. 5(*b*) is a back view showing the other face thereof and FIG. 5(*c*) is enlarged cross sectional view of a part of the substrate.

As shown in FIGS. 1, 2 and 5, the connection substrate 43 has an insulating substrate main body 56 having insulation properties, a pair of electric wire connection portions 57 constituted by pad portions of a conductive layer is formed on one face (see FIG. 5(*a*)) of the insulating substrate main body 56, a pair of substrate connection portions 58 constituted by pad portions of a conductive layer for connection to the module substrate 41 is formed on the other face (see FIG. 5(*b*)) of the insulating substrate main body 56, and the connection portions 57 and 58 on both faces are formed in the same region and electrically connected to each other via a plurality of through-holes 59. A covering portion 60 is formed in an edge portion of one end side of the insulating substrate main body 56, the covering portion 60 being arranged on the through-hole 46 so as to cover at least a part of the through-hole 96 with the connection substrate 93 mounted on the module substrate 41. A half-circle-shaped notch portion 62 as an electric wire holding portion 61 is formed in the covering portion 60. The notch portion 62 is arranged in an inside region located away from a circumferential edge portion of the through-hole 46, with the connection substrate 93 mounted on the module substrate 41. The connection portions 57 and 58 are arranged in parallel with the notch portion 62 on the other end side opposite from the notch portion 62, of the insulating substrate main body 56. A flat portion 63 is formed at the center region between the electric connection portions 57 and the notch portion 62 on one face of the connection substrate 43.

Solder paste is applied to the pad portions 50 and 51 of the module substrate 41, the SMD package 53 is mounted on the solder paste of each pad portion 50 so that the terminals on the back face of the SMD package 53 are connected to the solder paste, and the connection substrate 43 is mounted on the solder paste of the pad portions 51 so that the substrate connection portions 58 of the other face side of the substrate 43 are connected to the solder paste. Since the flat portion 63 is here formed at the center of the connection substrate 43, the flat portion 63 can be mounted sticking on the solder paste by a mounting machine. Accordingly, the connection substrate 43 can be automatically mounted together with the SMD packages 53 by the mounting machine. By applying heat after mounting, the SMD packages 53 and the connection substrate 43 are connected and fixed to the module substrate 41 by solder.

The other face of the module substrate 41 is joined and arranged to the attachment face 27 of the base body 12, screws 64 are screwed into the attachment holes 28 of the base body 12 through the attachment grooves 47 of the module substrate 41, and thus the other face of the module substrate 41 is attached to the base body 12 brought into face-contact with the attachment face 27 of the base body 12. Here, a thermally conductive material such as a sheet or grease excellent in thermal conductivity is interposed between the other face of the module substrate 41 and the attachment face 27 of the base body 12. The through-hole 46 of the module substrate 41 coaxially communicates with the wiring hole 31 of the base body 12 with the module substrate 41 attached to the attachment face 27 of the base body 12.

The cover 14 is cylindrically formed of an insulating material such as PBT resin so as to be opened toward the other end side. An annular flange portion 71, which is interposed between the base body 12 and the cap 15 for insulating these from each other, is formed at an outer circumferential portion of the other end side of the cover 14. A wiring hole 72 coaxially communicating with the wiring hole 31 of the base body 12 is formed in a face of one end side of the cover 14.

The cap 15 is, for example, an E26 type or E17 type cap which can be connected to a socket for general bulbs and has a shell 75 engaged with, caulked by and fixed to the cover 14; an insulating portion 76 provided at the other end side of the shell 75; and an eyelet 77 provided at a top portion of the insulating portion 76.

The globe 16 is formed of glass or synthetic resin, which has light diffuseness is in a dome shape so as to cover the light-emitting module 13. The other end side of the globe 16 is opened, and an engaging portion 79, which is engaged with and fixed to an inner circumferential side of the attachment portion 29 of the base body 12 by adhesive or the like, is formed at an edge portion of the opening of the globe 16.

The lighting circuit 17 is, for example, a circuit for supplying constant current to the LED chips 42 of the light-emitting module 13, and has a circuit substrate (not shown) on which a plurality of circuit elements constituting the circuit are mounted, and the circuit substrate is housed in the cover 14.

The shell 75 and eyelet 77 of the cap 15 are electrically connected to an input side of the lighting circuit 17 via connection wires (not shown).

A pair of electric wires 81 is connected to an output side of the lighting circuit 17, these electric wires 81 are inserted into the wiring hole 72 of the cover 14, the wiring hole 31 of the base body 12 and the through-hole 46 of the module substrate 41 and connected to the electric wire connection portions 57 of the connection substrate 43 by solder 82 respectively. A coated electric wire, in which a lead wire 83 is coated with a coating body 84, is used for the electric wire 81, the coating body 84 at the top end is peeled off, the lead wire 83 is exposed, and the lead wires 83 at the top end are connected to the electric wire connection portions 57 of the connection substrate 43 by the solder 82 respectively.

In assembling the self-ballasted lamp 11, before the light-emitting module 13 is screwed into the base body 12, the pair of electric wires 81 of the lighting circuit 17 is pulled out to one end side of the base body 12 through the wiring hole 72 of the cover 14 and the wiring hole 31 of the base body 12, inserted into the through-hole 46 of the module substrate 41 and connected to the electric wire connection portions 57 of the connection substrate 43 by the solder 82 respectively.

Here, the electric wires 81 inserted in the through-hole 46 of the module substrate 41 are fitted into the notch portion 62, which is the electric wire holding portion 61 of the connection substrate 43 and thus positioned and held in relation to the connection substrate 43. Therefore, if a top end side of each electric wire 81 is brought down onto the connection substrate 43, the lead wire 83 at the top end of each electric wire 81 can be easily arranged on each electric wire connection portion 57 of the connection substrate 43 and can be easily soldered onto each electric wire connection portion 57.

Figure 6:
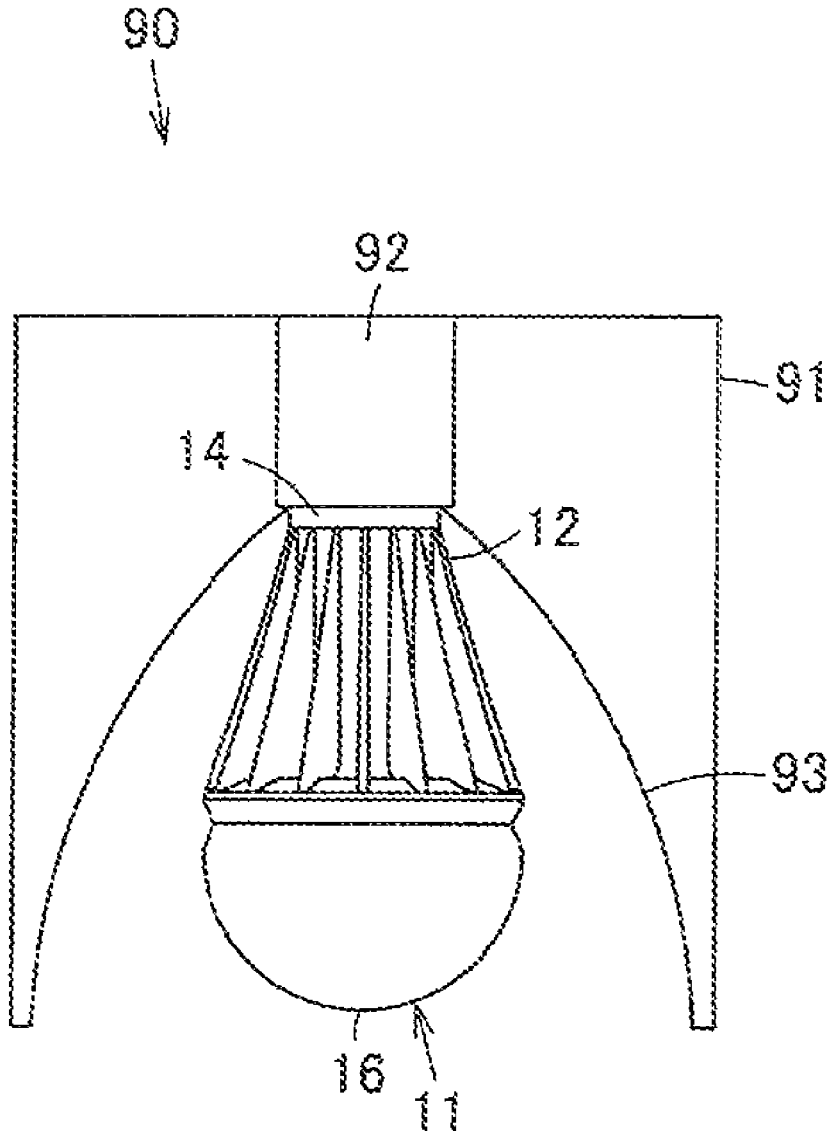
FIG. 6 is a cross sectional view of lighting equipment using the self-ballasted lamp.

FIG. 6 shows lighting equipment 90 as a downlight using the self-ballasted lamp 11, the lighting equipment 90 has an equipment body 91, and a socket 92 and a reflecting body 93 are disposed in the equipment body 91.

When the self-ballasted lamp 11 is energized by attaching the cap 15 to the socket 92 of the lighting equipment 90, the lighting circuit 17 operates, power is supplied to the plurality of LED chips 42 of the light-emitting module 13, the plurality of LED chips 42 emit light, and the light is diffused and emitted through the globe 16.

Heat generated when the plurality of LED chips 42 are lit is conducted to the module substrate 41 and further conducted from the module substrate 41 to the base body 12, and of radiated into the air from surfaces of the base body portion 21 and the plurality of heat radiating fins 22, which are exposed outward of the base body 12.

In the self-ballasted lamp 11, since the connection substrate 43 is mounted on the conductive layer 49 constituting one face of the module substrate 41 and the electric wires 81, which extend from the lighting circuit 17 and are inserted into the through-hole 46 from the other face side to the one face side of the module substrate 41, can be connected to the connection substrate 43, a connection portion of the electric wires 81 to the module substrate 41 can be suppressed to only the height of the connection substrate 43 and the electric wires 81. Thus, light emitted from the LED chips 42 is difficult to block at the connection portions of the electric wires 81 to the module substrate 41, and influence on optical characteristics can be reduced. Additionally, no connector is required to be used for connection of the electric wires 81, and the cost can be suppressed.

On one face side of the connection substrate 43, the electric wire connection portions 57 to which the electric wires 81 are connected are formed, on the other face side thereof, the substrate connection portions 58 connected to the conductive layer 49 constituting one face of the module substrate 41 are formed, and the plurality of through-holes 59 for connecting the electric wire connection portions 57 and substrate connection portions 58 to each other are formed. Therefore, in the cases where the connection substrate 43 is connected to the module substrate 41 by soldering and the electric wires 81 are connected to the connection substrate 43 by soldering, a part of the solder paste enters the through-holes 59, connection intensity and electrical properties can be improved, and protrusion of the excess solder paste from an edge of the connection substrate 43 can be reduced. Moreover, the through-holes 59 may be in plural or singular number.

Additionally, by the electric wire holding portion 61 of the connection substrate 43, the electric wires 81, which are inserted into the through-hole 46 from the other face side to the one face side of the module substrate 41, can be positioned and held, and can be easily connected to the connection substrate 43.

Additionally, since the connection substrate 43 can be connected to the module substrate 41 together with the SMD packages 53, on which the LED chips 42 are loaded, respectively, by reflow soldering, productivity can be improved.

Figure 7:
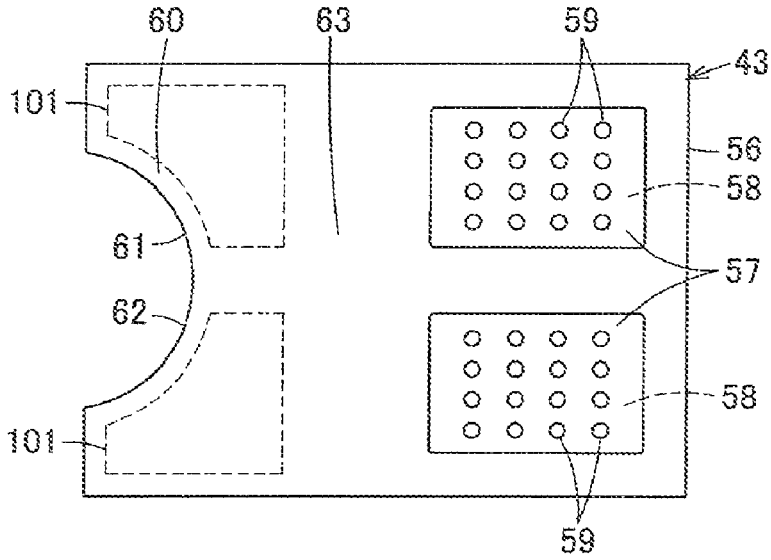
FIG. 7 is a front view of a connection substrate of a light-emitting module of Embodiment 2.

Next, Embodiment 2 will be described with reference to FIG. 7. Moreover, the same symbols are attached to the same structures as those of Embodiment 1, and description of the structure will be omitted.

On the other face side of the connection substrate 43 to be mounted on the module substrate 41, a pair of substrate connection portions 58 and a pair of dummy pad portions 101 not electrically connected to the module substrate 41 are formed. These dummy pad portions 101 are formed at one end side, on which the electric wire holding portion 61 of the connection substrate 43 is formed, that is, approximately symmetrically arranged at one end side opposite from the other end side of the connection substrate on which the pair of substrate connection portions 58 are arranged. Accordingly, the electric wire holding portion 61 and the dummy pad portions 101 are arranged in the vicinity of four corners of the connection substrate 43, respectively.

In the reflow soldering, the solder paste is applied to the pad portions 51 and positions corresponding to the dummy pad portions 101 of the connection substrate 43 of one face of the module substrate 41, and both the electric wire holding portion 61 and dummy pad portions 101 of the connection substrate 43, which are to be mounted on the module substrate 41, are arranged on the solder paste.

Since the solder melts by heating after mounting, the connection substrate 43 moves so as to approach be connected to the module substrate 41. Here, the electric wire holding portion 61 and the dummy pad portions 101 are arranged in the vicinity of the corners of the connection substrate 43, thereby the connection substrate 43 balancedly moves so as to approach the module substrate 41 so that positional deviation of the connection substrate 43 can be reduced.

Assuming that only the electric wire holding portion 61 is disposed at the other end side of the connection substrate 43, the connection substrate 43 sometimes moves to one end side or the other end side and positionally deviates when the solder melts. However, since the electric wire holding portion 61 and the dummy pad portions 101 are arranged in the vicinity of the corners of the connection substrate 43, such positional deviation of the connection substrate 43 can be reduced.

Figure 8:
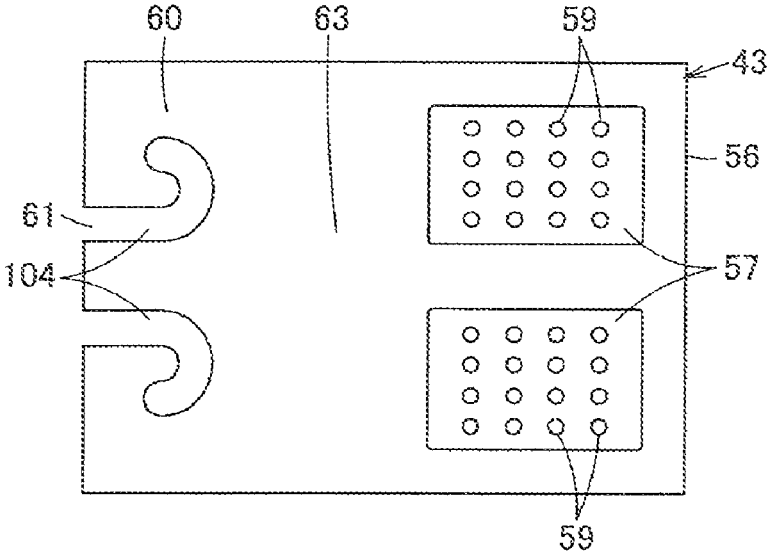
FIG. 8 is a front view of a connection substrate of a light-emitting module of Embodiment 3.

Next, Embodiment 3 will be described with reference to FIG. 8. Moreover, the same symbols are attached to the same structures as those of Embodiment 1, and description of the structure will be omitted.

The electric wire holding portion 61 of the connection substrate 43 is formed by a pair of groove portions 104 into which the electric wires 81 are inserted respectively. A far end side of the groove portion 104 is curved and has a groove width smaller than a diameter of the coating body 84 of the electric wire 81 so that the electric wire 81 inserted into the groove portion 104 is strongly clamped and can be positioned and held.

Figure 9:
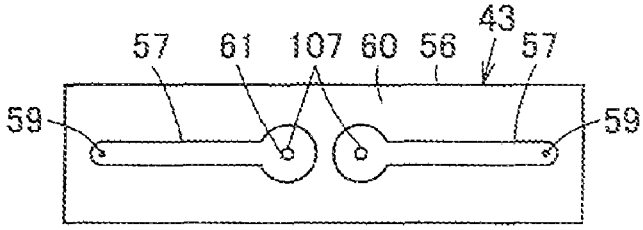
FIG. 9 show a module substrate and a connection substrate of a light-emitting module of Embodiment 4, FIG. 9(*a*) is a front view showing one face of the connection substrate, FIG. 9(*b*) is a cross sectional view of the module substrate and connection substrate and FIG. 9(*c*) is a back view showing the other face of the connection substrate.
Figure 9:
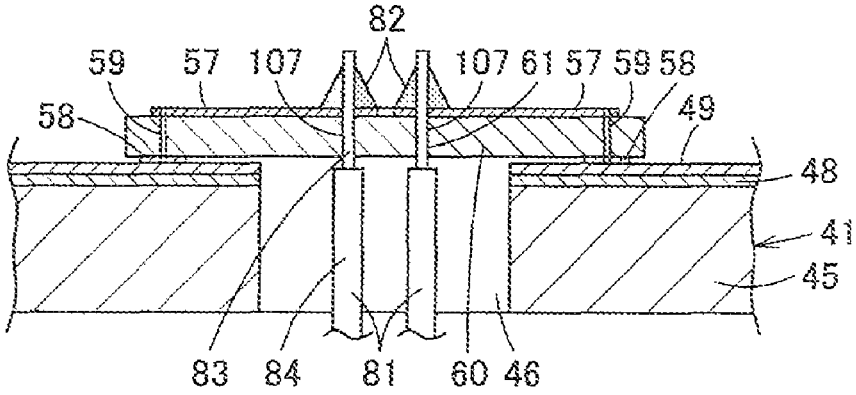
Figure 9:
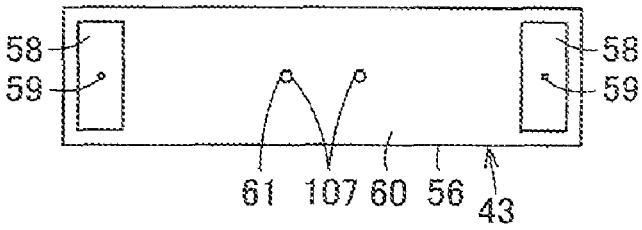

Next, Embodiment 4 will be described with reference to FIG. 9. Moreover, the same symbols are attached to the same structures as those of Embodiment 1, and description of the structure will be omitted.

The connection substrate 43 is rectangular, and the electric wire connection portions 57, the substrate connection portions 58 and the through-holes 59 are respectively formed at both end sides symmetrically with respect to a center line as a border in the longitudinal direction. A pair of insertion holes 107, into which the lead wires 83 of the electric wires 81 are inserted from the other face side to the one face side of the connection substrate 43, as the electric wire holding portion 61 is formed at the center portion of the connection substrate 43.

The substrate connection portions 58 at both ends of the connection substrate 43 are mounted on the module substrate 41 by the reflow soldering. In assembling the self-ballasted lamp 11, the lead wire 83 of each electric wire 81 inserted in the base body 12 is inserted into the insertion hole 107 of the connection substrate 43 and connected to the electric wire connection portion 57 by the solder 82.

The electric wires 81 thus can be soldered to the electric wire connection portions 57 from the one face side of the connection substrate 43 from the one face side of the module substrate 41 mounting the connection substrate 43, and connection work can be easily performed.

Moreover, the electric wire connection portion 57 of the connection substrate 43 is constituted by the pad portion in the above embodiments, but is not limited to this, for example, wrapping pins may be erected from the connection substrate 43 and wrapped around by the electric wires 81 for solder connection.

Additionally, although the through-hole 46 is formed on the module substrate 41 and the electric wires 81 are inserted into the through-hole 46 so as to be connected to the connection substrate 43 in the above embodiments, the through-hole 46 does not have to be formed in the module substrate 41 and the electric wires 81 may be connected to the connection substrate 43 through the outside of the module substrate 41.

Additionally, as the semiconductor light-emitting element, an EL (Electro Luminescence) element can be used in place of the LED chip 42. In the case of LEDs, a COB (Chip On Board) module may be used on which a plurality of LED chips are mounted on a module substrate and covered with a phosphor layer.

Additionally, the light-emitting module 13 can be used for not only the self-ballasted lamp 11 but also ceiling attachment type or wall attachment type lighting equipment, etc.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A light-emitting module comprising:

a module substrate having a conductive layer on one face side, the one face side comprising a first region and a second region;

semiconductor light-emitting elements mounted directly on the first region of the one face side of the module substrate having the conductive layer; and a connection substrate which is mounted on the second region of the one face side of the module substrate having the conductive layer, to which electric wires, which extend from a lighting circuit, are connected and which supplies power from the lighting circuit to the semiconductor light-emitting elements through the connection substrate.

2. The light-emitting module according to claim 1, wherein on one face of the connection substrate, electric wire connection portions to which the electric wires are connected are formed, on the other face of the connection substrate, substrate connection portions to be connected to the conductive layer of the module substrate are formed, and through-holes for connecting the electric wire connection portions and the substrate connection portions are formed in the connection substrate.

3. The light-emitting module according to claim 1, wherein an electric wire holding portion for holding the electric wires is formed in the connection substrate.

4. The light-emitting module according to claim 1, wherein the semiconductor light-emitting elements and the connection substrate are connected to the module substrate by reflow soldering.

5. A self-ballasted lamp comprising:

the light-emitting module according to claim 1;

a base body having the light-emitting module at its one end side;

a cap provided at the other end side of the base body; and a lighting circuit which is housed between the base body and the cap and has the electric wires to be connected to the connection substrate.

6. Lighting equipment comprising:

an equipment body having a socket; and the self-ballasted lamp according to claim 5 attached to the socket of the equipment body.

7. The self-ballasted lamp according to claim 5, wherein an electrical connection path comprising the lighting circuit, the electric wires, the connection substrate, the module substrate, and the semiconductor light-emitting elements, in order, is formed by electrically connecting the module substrate and the connection substrate.

8. The light-emitting module according to claim 1, wherein the first region is a peripheral region and the second region is a center region.

* * * * *